US010046835B2

(12) United States Patent
Ryan

(10) Patent No.: US 10,046,835 B2
(45) Date of Patent: Aug. 14, 2018

(54) VESSEL WITH UNITARY BOW DOOR AND MULTI-FOLD RAMP

(71) Applicant: FULCRUM BOAT CORPORATION, Raleigh, NC (US)

(72) Inventor: Peter Derek Ryan, Raleigh, NC (US)

( * ) Notice: Subject to any disclaimer, the term of this patent is extended or adjusted under 35 U.S.C. 154(b) by 0 days.

(21) Appl. No.: 15/584,200

(22) Filed: May 2, 2017

(65) Prior Publication Data

US 2017/0320550 A1 Nov. 9, 2017

Related U.S. Application Data

(60) Provisional application No. 62/391,540, filed on May 3, 2016.

(51) Int. Cl.

| | |
|---|---|
| ***B63B 35/44*** | (2006.01) |
| ***B63B 27/14*** | (2006.01) |
| ***B63B 19/08*** | (2006.01) |

(52) U.S. Cl.

CPC ..... *B63B 27/14* (2013.01); *B63B 19/08* (2013.01); *B63B 2019/083* (2013.01)

(58) Field of Classification Search

CPC ..... B63B 27/14; B63B 19/08
USPC ..... 114/258–260
See application file for complete search history.

(56) References Cited

U.S. PATENT DOCUMENTS

| | | | | |
|---|---|---|---|---|
| 9,873,490 | B2 * | 1/2018 | Day | B63B 27/143 |
| 2009/0056611 | A1 * | 3/2009 | Hirayama | B63B 19/08 114/259 |
| 2014/0158038 | A1 * | 6/2014 | Johnston | B63B 27/143 114/355 |

* cited by examiner

*Primary Examiner* — Stephen P Avila
(74) *Attorney, Agent, or Firm* — Carla Gannon Law

(57) ABSTRACT

A powered water vessel includes a unitary section of the bow that is pivotably rotatable about a horizontal axis thereby permitting a closed-bow configuration and an opened-bow configuration. The closed-bow configuration is generally amenable to regular boat operations, while the opened-bow configuration is generally amenable to loading and unloading passengers, vehicles and/or cargo. A folding ramp assembly is extendable through the open-bowed configuration for loading and unloading, with track extensions providing additional extension distance.

11 Claims, 17 Drawing Sheets

VESSEL WITH UNITARY BOW DOOR AND MULTI-FOLD RAMP

CROSS-REFERENCE TO RELATED APPLICATIONS

This application claims the benefit of U.S. Provisional Patent Application 62/391,540 entitled VESSEL WITH SINGLE PIECE BOW DOOR AND MULTI-FOLD RAMP, filed on May 3, 2016.

BACKGROUND

Field

The following embodiments relate to a powered water vessel, and more particularly, to water vessels having a unitary bow door and multi-fold ramp.

Related Art

Water vessels come in a variety of sizes, shapes and configurations, depending on the type of vessel. By convention, some water vessels include a forward ramp as the bow section. This configuration can often be found in vessels used in private or charter yacht support and supply; surveying; search and rescue operations; firefighting operations; patrol; island supply and/or light cargo operations often. This configuration, however, unfortunately limits the size of the ramp due to visibility concerns and/or poor handling due to the interaction between the flat bow section and the water.

Accordingly, there is a need for a forward ramp system that doesn't impede visibility, and doesn't negatively affect handling.

SUMMARY OF THE INVENTION

The present invention generally pertains to vessels with a conventionally shaped bow but including a bow section that may be pivoted about a horizontal axis, or supported by suitable linkages, to provide an opening at the forward end of the vessel. The opening is of adequate size so that various vehicles and/or cargo may be transported through the opening. The vessel also includes a ramp with multiple folding sections, and optionally extension tracks, for improved vehicular movement.

Changing the vessel configuration from "closed" for normal running to "open" for loading or unloading requires the movable bow section to be driven to the "open" position before the ramp can be unfolded and/or extended. Conversely, returning the vessel to normal operation requires the ramp to be returned to the "closed" position before the movable bow section can also be returned to the "closed" position.

In various embodiments, the movable bow section may be opened or closed using manual drive means, or by, but not limited to, hydraulic or pneumatic cylinders or rotary actuators, or by, but not limited to, electric rotary actuators or linear actuators. The ramp may be unfolded and extended manually, or may be wholly or partially unfolded and extended through the use of electric linear actuators, hydraulic cylinders, rotary actuators or other powered actuation means at or coupled about the hinge line of the folding action. In some embodiments the ramp may have two or more hinged sections and may include track extensions which may be extended or unfolded from the outermost ramp section in the open or extended configuration.

In a first aspect, a water vessel is provided that includes a hull, a planar deck which is positioned in the hull substantially lower than the top of the hull sides and a ramp. The hull has a curved front end (the bow), a port side, a starboard side, a bottom and a stern at the aft end. A portion of the bow is movable between a closed configuration and an open configuration. The planar deck is fixed aft of the movable part of the bow section. When the movable part of the bow section is in the open configuration the ramp is movable to an extended position in which the top surface of the first section of the ramp is nominally aligned with the upper surface of the deck and the first section of the ramp extends beyond the fixed part of the bow section and the second section is unfolded from its closed position above the first section. Conversely, to return to the closed configuration, the second section of the ramp is folded back to its position above the first section, the first section of the ramp is returned to its closed position then the movable part of the bow section is moved to its closed position.

In a second aspect, a water vessel is provided that includes a hull, a planar deck which is positioned in the hull substantially lower than the top of the hull sides, a ramp and a motor or motors. The hull has a curved front end (the bow), a port side, a starboard side, a bottom and a stern at the aft end. A portion of the bow is movable between a closed configuration and an open configuration. The planar deck is fixed aft of the movable part of the bow section. The motor or motors is/are coupled to the movable section of the bow that is supported by hinge means with a hinge line close to the top of the hull sides or by linkages attached by pivoting means to the hull sides and the movable section of the bow. The motors are configured to drive the movable bow section to its fully open configuration or its fully closed configuration.

In a third aspect, a water vessel is provided that includes a hull, a planar deck which is positioned in the hull substantially lower than the top of the hull sides, a ramp and a motor or motors. The hull has a curved front end (the bow), a port side, a starboard side, a bottom and a stern at the aft end. A portion of the bow is movable between a closed configuration and an open configuration. The planar deck is fixed aft of the movable part of the bow section. One or more motors are coupled to the ramp that is supported by hinge means or a suitable linkage means so that the ramp in the open position has the top surface of the first section of the ramp nominally aligned with the upper surface of the fixed planar deck and in the closed position is aligned at an angle to the upper surface of the fixed planar deck, the actual closed position being governed by the geometry of the movable bow section. The motors are configured to drive the first section of the ramp to its fully open configuration or its fully closed configuration and the second and any further ramp sections to fully open, fully closed or any intermediate configuration.

In a fourth aspect, a water vessel is provided that includes a hull, a planar deck which is positioned in the hull substantially lower than the top of the hull sides, a ramp and a motor or motors. The hull has a curved front end (the bow), a port side, a starboard side, a bottom and a stern at the aft end. A portion of the bow is movable between a closed configuration and an open configuration. The planar deck is fixed aft of the movable part of the bow section. One or more motors are coupled to the ramp that is supported by hinge means or a suitable linkage means so that the ramp in the open position has the top surface of the first section of the ramp nominally aligned with the upper surface of the fixed planar deck and in the closed position is aligned at an angle to the upper surface of the fixed planar deck, the actual closed position being governed by the geometry of the movable bow section. The motor or motors is/are configured to drive the first section of the ramp to its fully open configuration or its fully closed configuration and the second and any further sections to fully open, fully closed or any intermediate configuration. Another motor or motors is/are configured to drive the movable bow section to its fully open configuration or its fully closed configuration.

DESCRIPTION OF THE PREFERRED EMBODIMENTS

Figure 1:
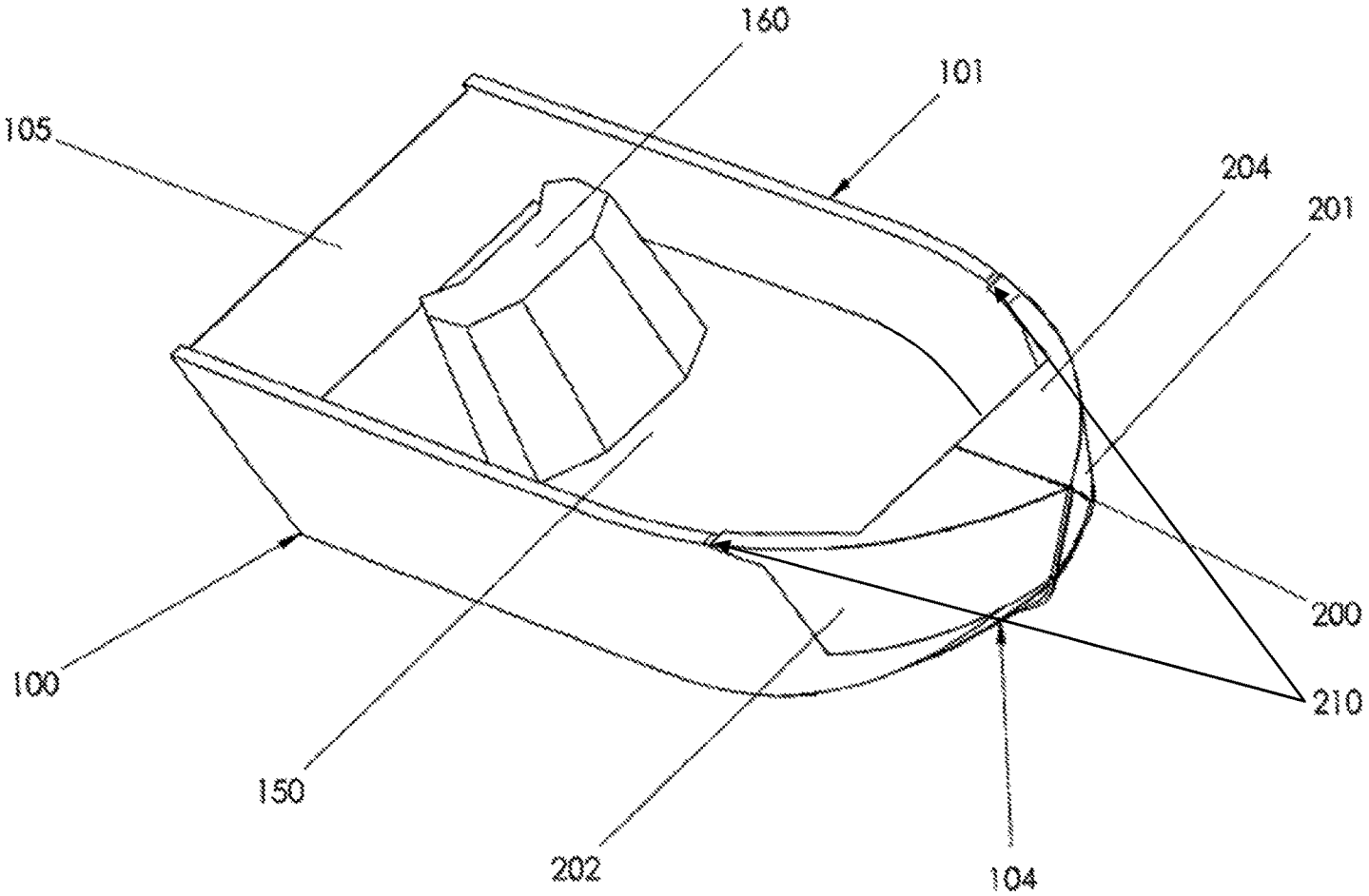
FIG. 1 is a perspective view of a vessel, according to one embodiment with a bow door in a fully closed configuration.
Figure 2:
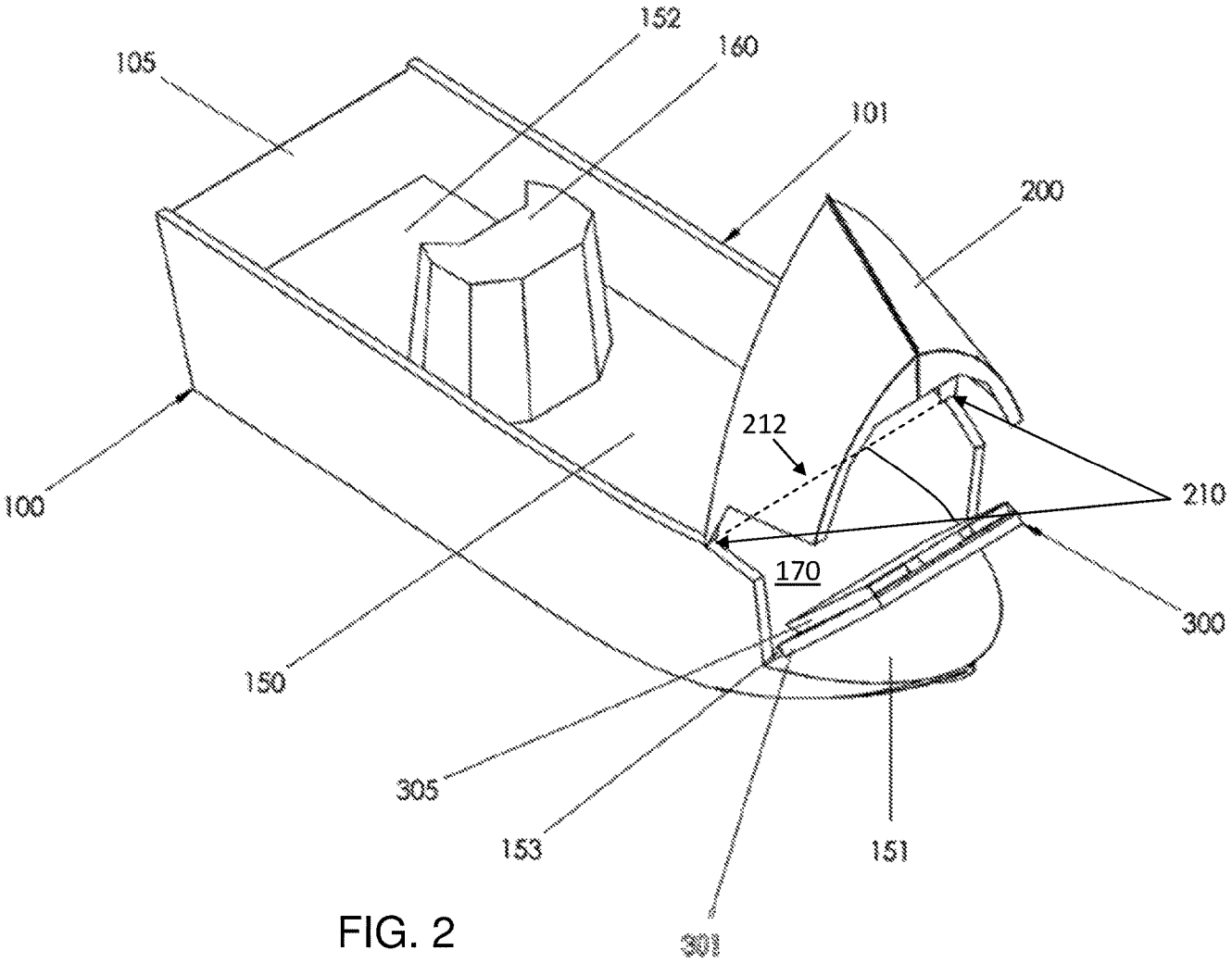
FIG. 2 is a perspective view of the vessel of FIG. 1 but with a bow door moved to an open configuration and showing a ramp assembly folded into its closed configuration.
Figure 3:
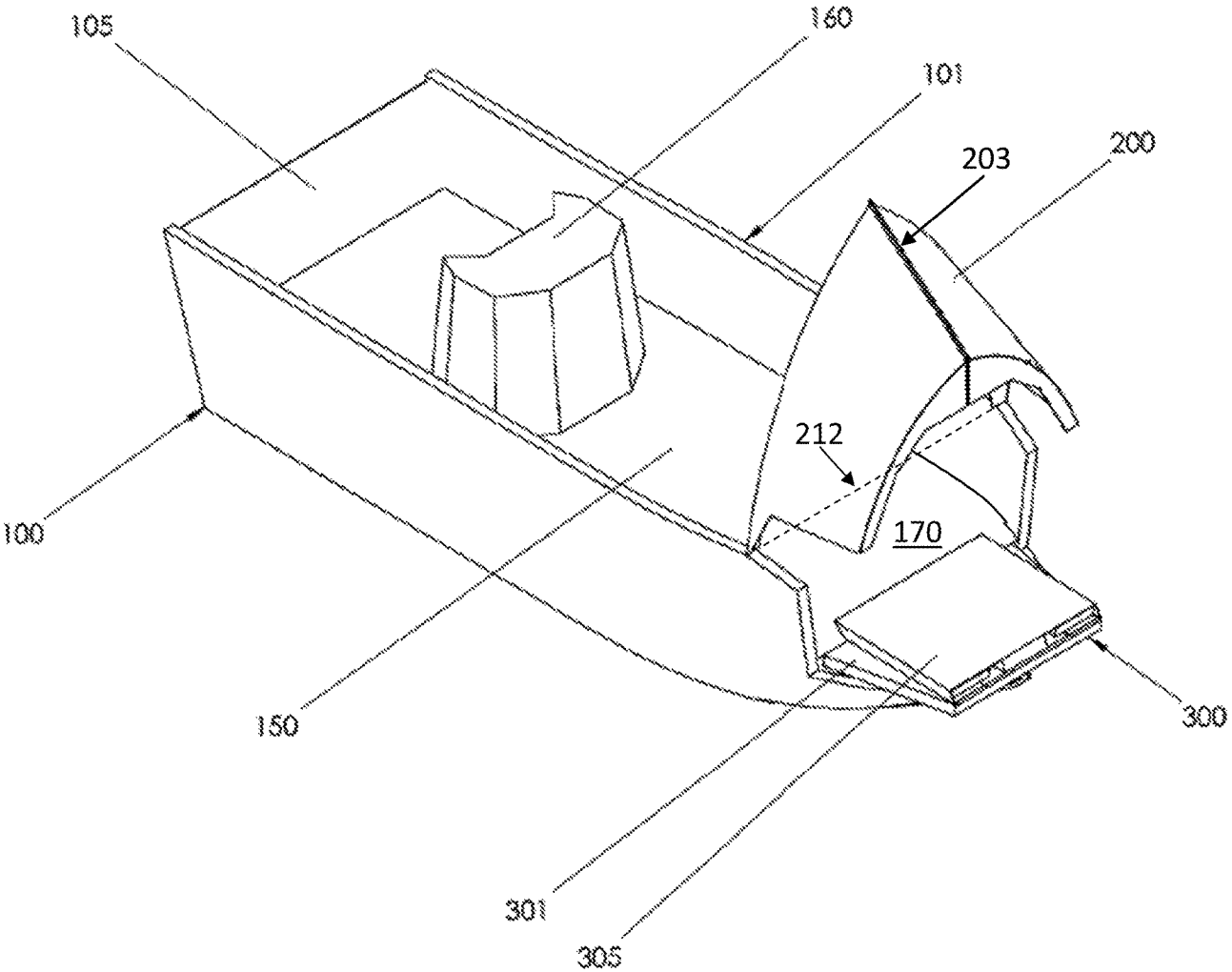
FIG. 3 is a perspective view of the vessel of FIG. 1 but with a bow door moved to an open configuration and a dual section ramp moved from its closed position shown in FIG. 2 to a first intermediate configuration.

The following detailed description discusses the best currently contemplated modes of carrying out exemplary embodiments of the invention. The description is not to be taken in a limiting sense, but is made merely for the purpose of illustrating the general principles of the invention.

The following structure numbers apply among the various FIGS.:

100—vessel;
101—hull;
104—hull bottom;
105—transom;
150—planar deck;
151—forward deck piece;
152—deck piece;
153—plate;
160—control station;
170—opening;
200—bow;
201—first corner;
202—second corner;
203—shared edge;
204—bow surface;
210—pivot point;
212—axis;
216—actuators;
300—folding ramp assembly;
301—first ramp section;
302—second embodiment folding ramp assembly;
303—third embodiment folding ramp assembly;
304—fourth embodiment folding ramp assembly;
305—second ramp section;
306—third ramp section;
307—third embodiment second ramp section;
308—dual track extensions;
309—fourth embodiment second ramp section;
310—single piece track extension; and
315—folding interface.

As used herein, the terms "water vessel", "vessel", "craft", "boat" and the like shall be used interchangeably.

As used herein, the term "unitary", as in a "unitary bow door" shall refer to one functional piece, although the one functional piece may be formed of multiple parts that are substantially permanently connected.

As used herein, "substantially continuous" shall mean that one section is similar to an adjacent section with respect to curvature, alignment and overall flow. By way of example, the hull of the vessel is substantially continuous with the unitary bow in the closed position insofar as they, together, create a smooth and consistent profile.

As used herein, "cargo" may include vehicles and passengers brought onto and off of a vessel.

As used herein, "planar", as in "planar deck" shall refer to generally planar notwithstanding various contours and features, and not necessarily smooth.

The terms forward, rearward, front, aft, side, top, bottom, underside and the like are used herein merely for reference and are not intended to limit in any way the specific or particular orientation of any components of the vessel 100. Nautical terms such as port and starboard, aft, transom and gunwale are also used herein in accordance with their ordinary meaning.

The present embodiments generally relate to water vessels that may be used for the purposes of, but not limited to, supply and light cargo operations, supply and support of larger vessels and marine structures, search and rescue operations and/or firefighting, with all envisioned purposes having the option of including the transportation of vehicles. Previously, boats used for such operations have typically been built with displacement hulls operating at low speeds or had blunt bows that made the boats difficult to operate in heavy or rough water conditions. The disclosed embodiments present a vessel or craft with a vee shaped bottom, a rounded bottom or a combination of both types of bottom configured to handle water which may be shallow or deep, calm or rough. Further, the strength and water tight integrity in the bow area is maximized since the vessel has conventional hull lines, including a sharp inclined bow and the movable part of the bow that can be opened and closed to facilitate loading and unloading of vehicles and cargo is a single unit.

All operations (including, but not limited to, supply and light cargo operations, support purposes for larger vessels or marine structures, offshore and remote onshore surveying, search and rescue, firefighting and/or offshore and remote onshore surveying operations) are facilitated by the unitary bow door and multi-folding ramp and by the ability to operate at high speed in many water conditions due to the efficiency of the hull and bow form.

The invention will be particularly described in reference to the accompanying drawings wherein FIG. 1 is an overall view of a vessel 100 configured for use in any type of water such as at sea, in a bay, on a lake, on a river or on an ocean.

The vessel 100 generally includes a hull 101, a deck 150, a control station 160, a movable bow section 200, a transom 105, and a folding ramp assembly which may take several forms but with a common first section 301. The vessel 100 is propelled by a motor or motors (not shown), and may be electrically powered from battery sources, hybrid powered, (with electric propulsion motor or motors supplied from batteries which are, in turn, charged by a generator or generators driven by an internal combustion engine or engines), or by a conventional internal combustion engine or engines which may be mounted inboard or outboard on the hull 101. The bottom 104 of the hull 101, may be vee shaped or generally vee shaped. In other embodiments the hull 101 may have a flat bottom, pontoon, round bilge or other shapes.

In the present embodiments, the movable part of the bow section 200 takes the form of a continuation of the main hull 101 but with the ability to pivot or rotate about pivot points 210, aft or close to, the aft end of the upper bow plate or surface 204. FIGS. 2 to 17 show various embodiments with the movable bow section 200 pivoted at pivot points 210 at substantially horizontal axis 212 into a fully open configuration.

The movable section of the bow 200 may be supported by other means than the pivot described in the present embodiment. For example, rather than a single pivot point 210, the movable section may be supported by a linkage with multiple pivot axes, which may still have its movement controlled manually or electrically, pneumatically or hydraulically.

Figure 4:
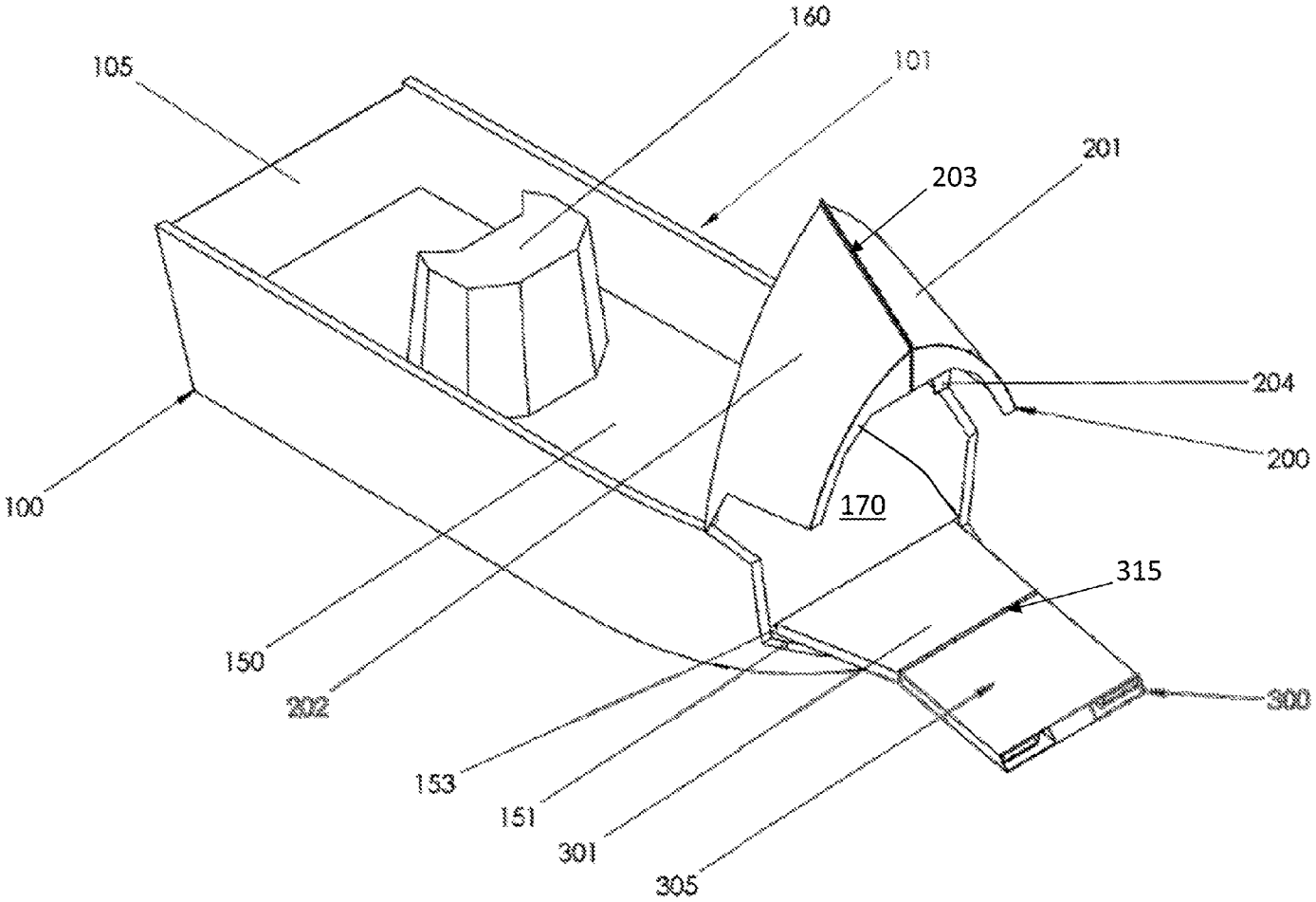
FIG. 4 is a perspective view of the vessel of FIG. 1 but with a bow door moved to an open configuration and a dual section folding ramp moved from its intermediate position shown in FIG. 3 to a final open configuration.
Figure 5:
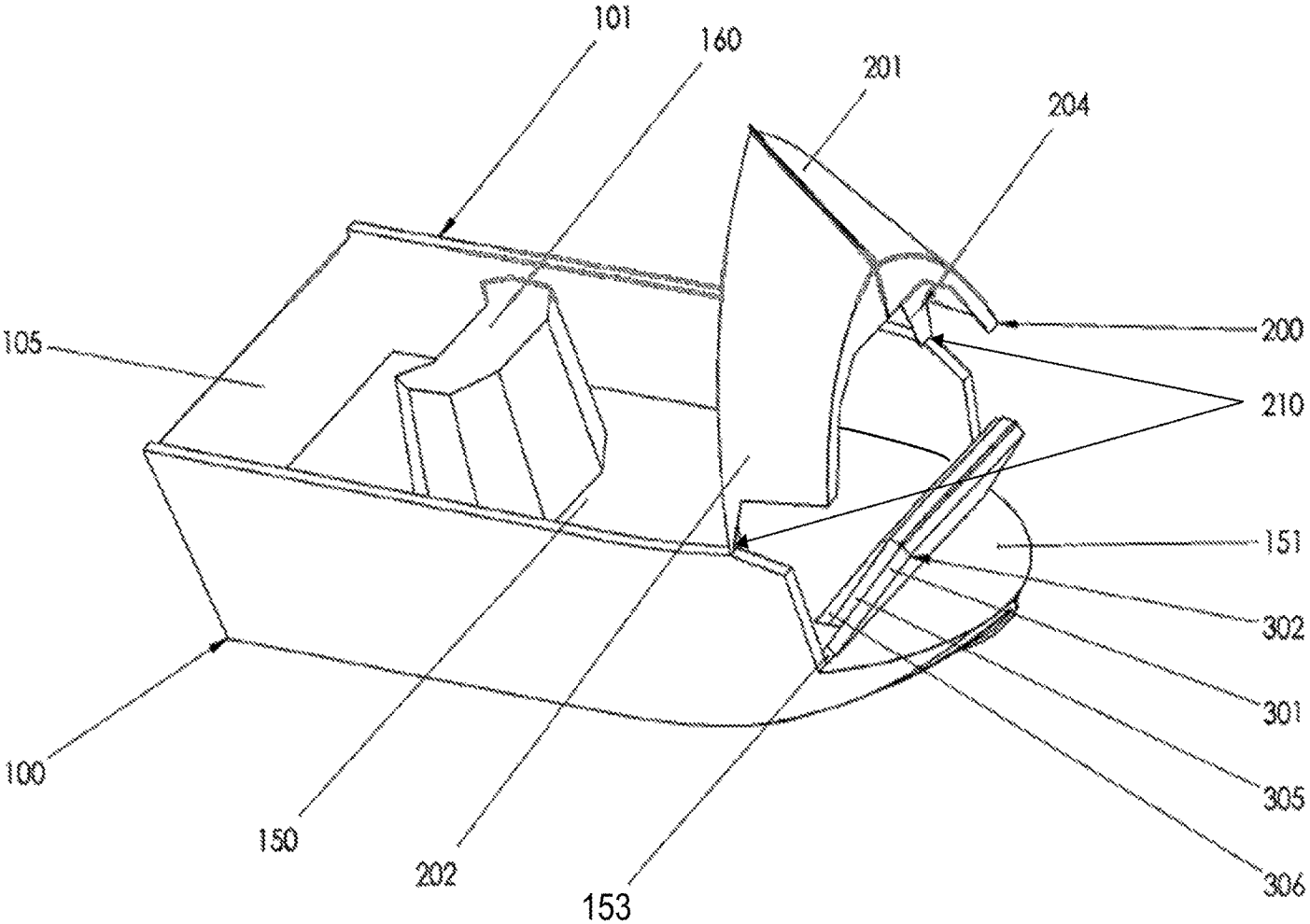
FIG. 5 is a perspective view of the vessel of FIG. 1 but with a bow door moved to an open configuration and a triple section ramp assembly folded into its closed configuration.
Figure 6:
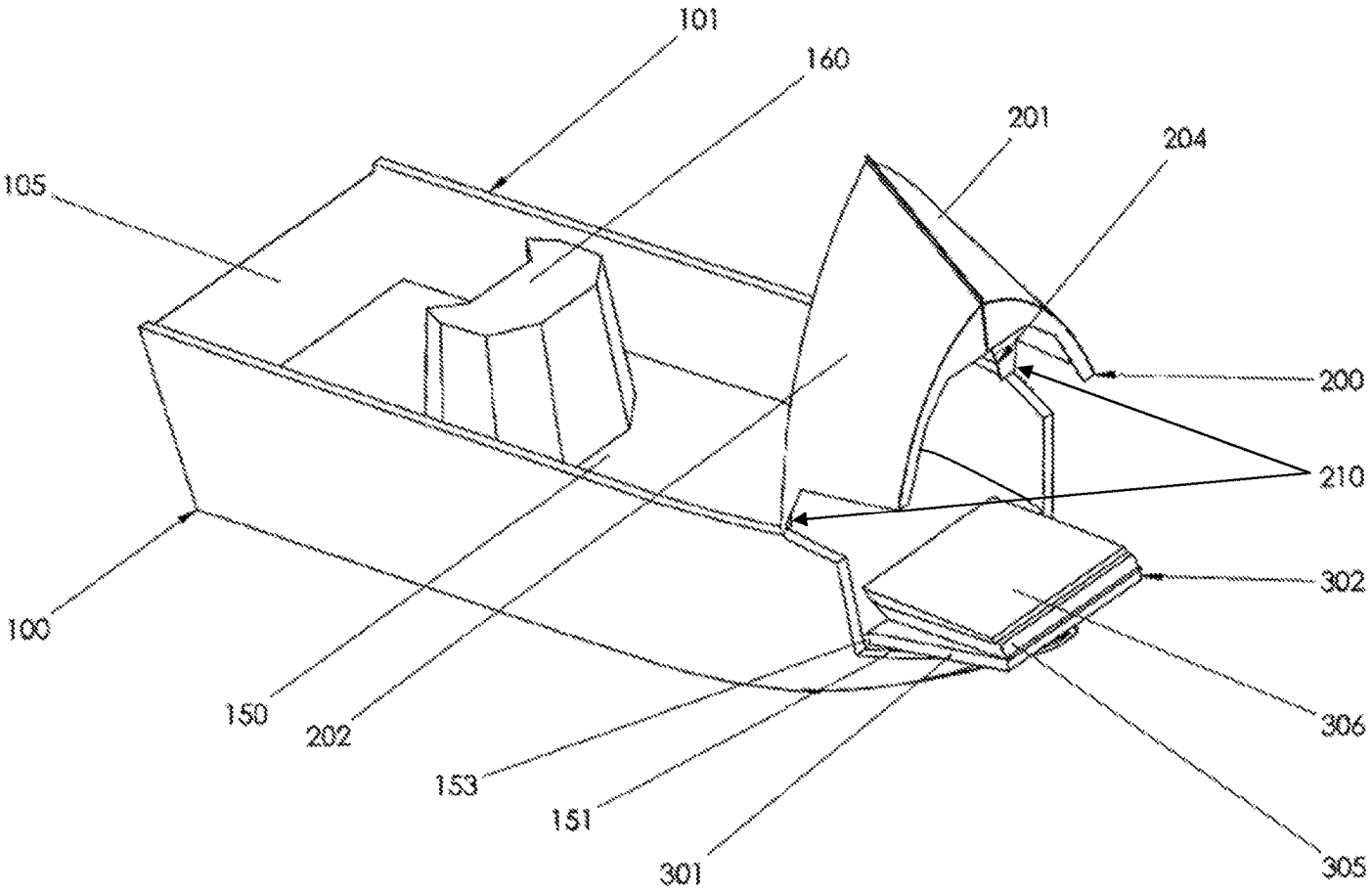
FIG. 6 is a perspective view of the vessel of FIG. 1 but with a bow door moved to an open configuration and a triple section ramp moved from its closed position shown in FIG. 5 to a first intermediate configuration.
Figure 7:
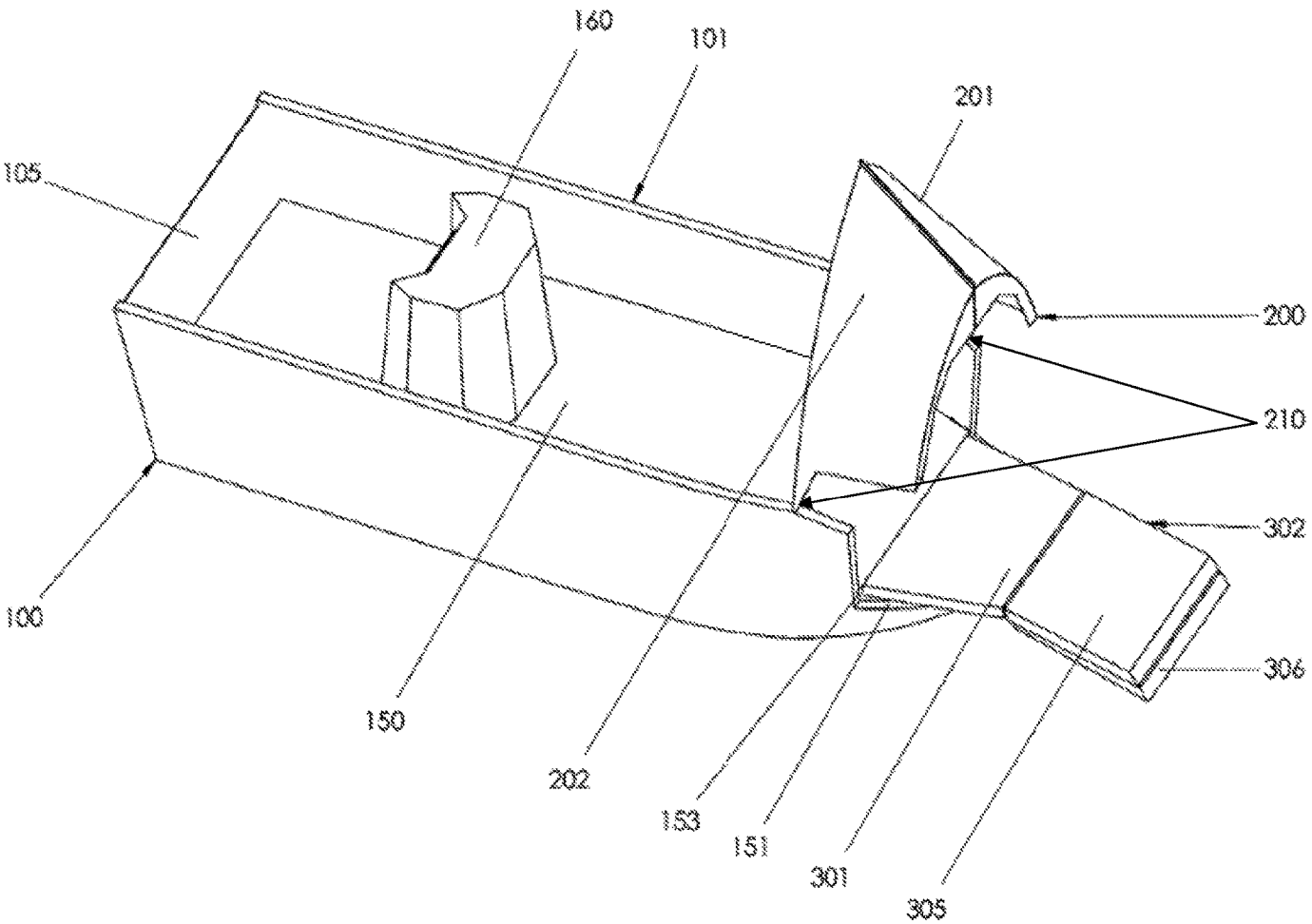
FIG. 7 is a perspective view of the vessel of FIG. 1 but with a bow door moved to an open configuration and a triple section ramp moved from its first intermediate position shown in FIG. 6 to a second intermediate configuration.
Figure 8:
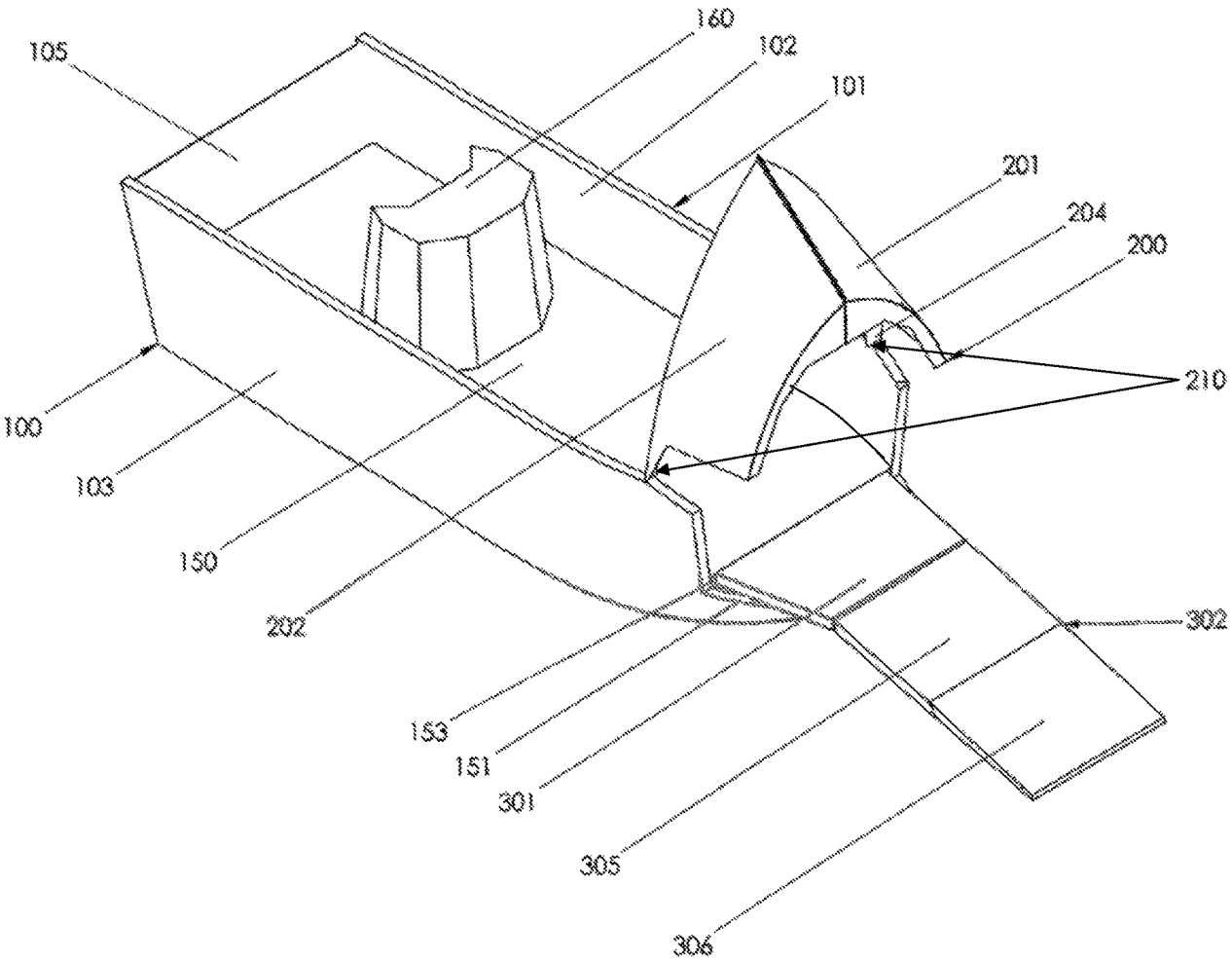
FIG. 8 is a perspective view of the vessel of FIG. 1 but with a bow door moved to an open configuration and a triple section folding ramp moved from its second intermediate position shown in FIG. 7 to a final open configuration.
Figure 9:
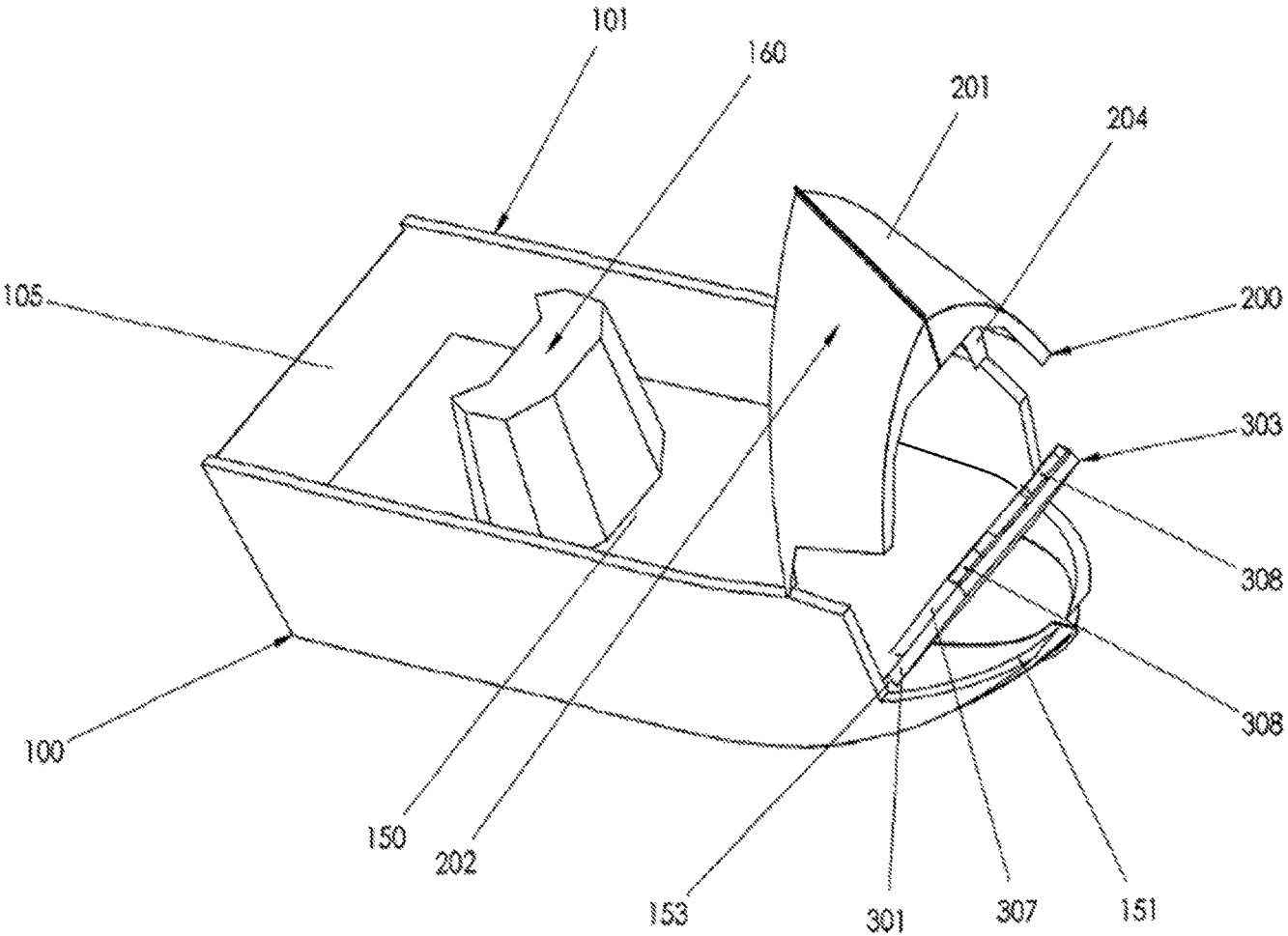
FIG. 9 is a perspective view of the vessel of FIG. 1 but with a bow door moved to an open configuration and a dual section ramp assembly with dual track extensions folded into its closed configuration.
Figure 10:
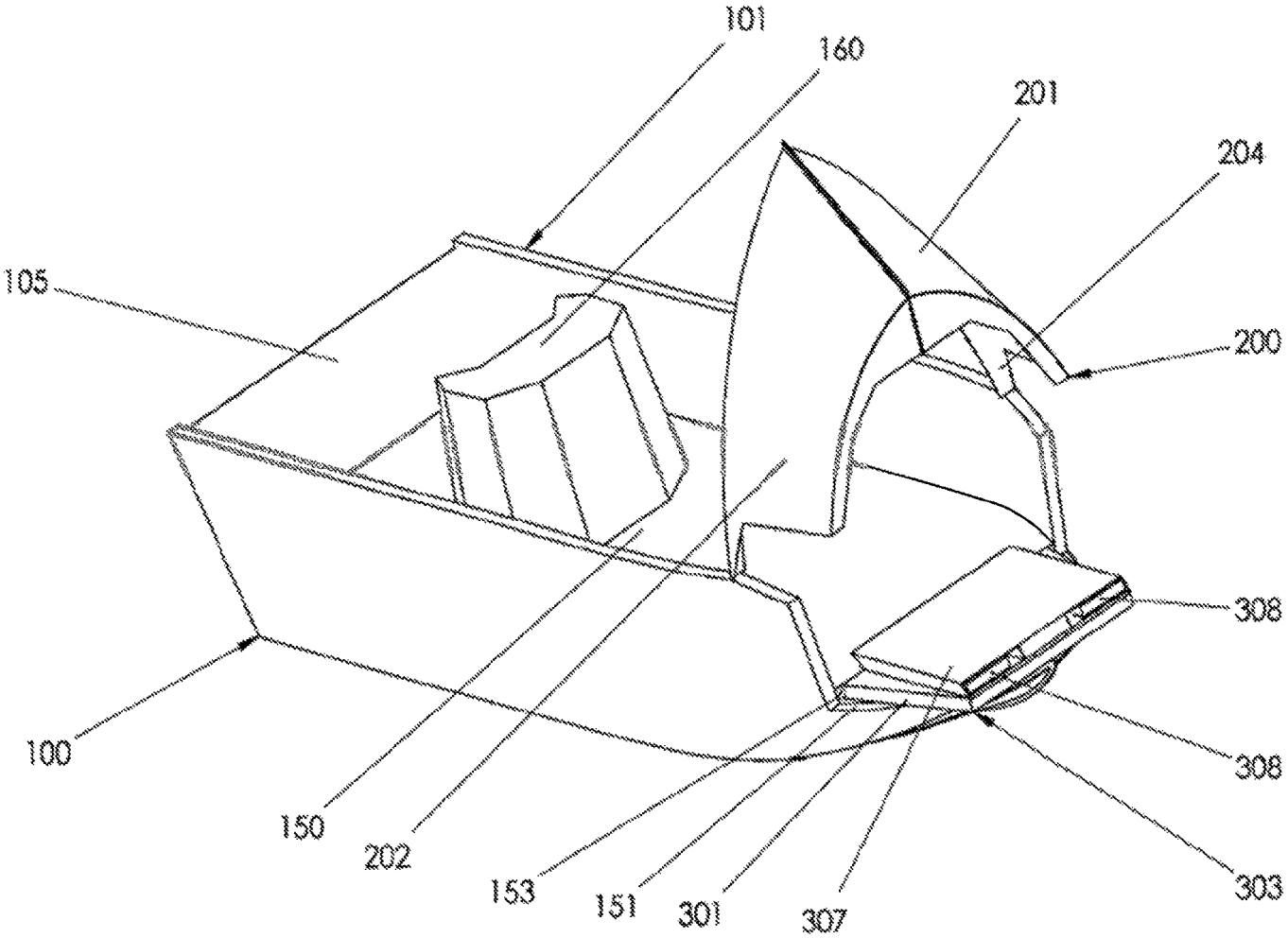
FIG. 10 is a perspective view of the vessel of FIG. 1 but with a bow door moved to an open configuration and a dual section ramp with dual track extensions moved from its closed position shown in FIG. 9 to a first intermediate configuration.
Figure 11:
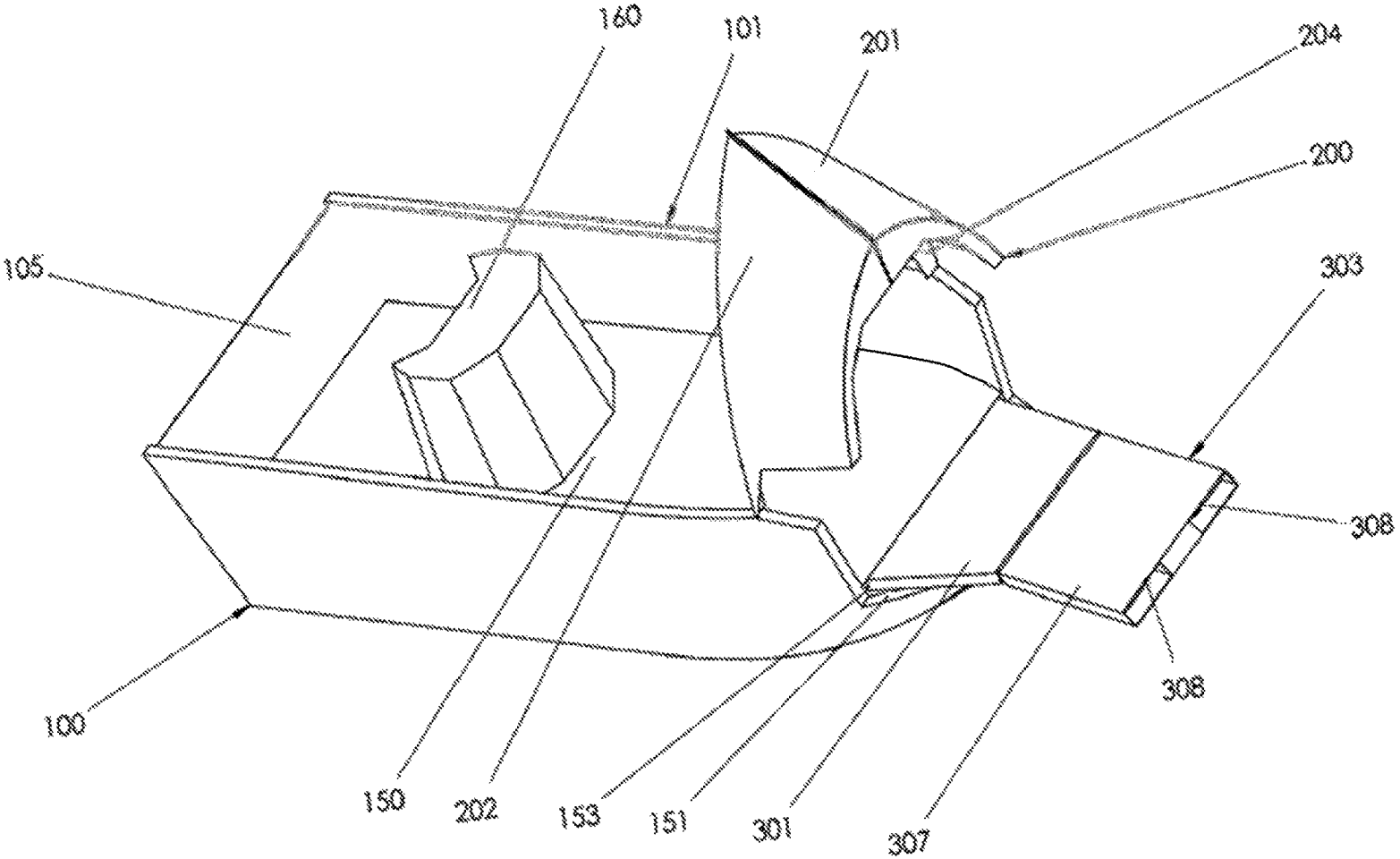
FIG. 11 is a perspective view of the vessel of FIG. 1 but with a bow door moved to an open configuration and a dual section ramp with dual track extensions moved from its intermediate position shown in FIG. 10 to a second intermediate configuration.
Figure 12:
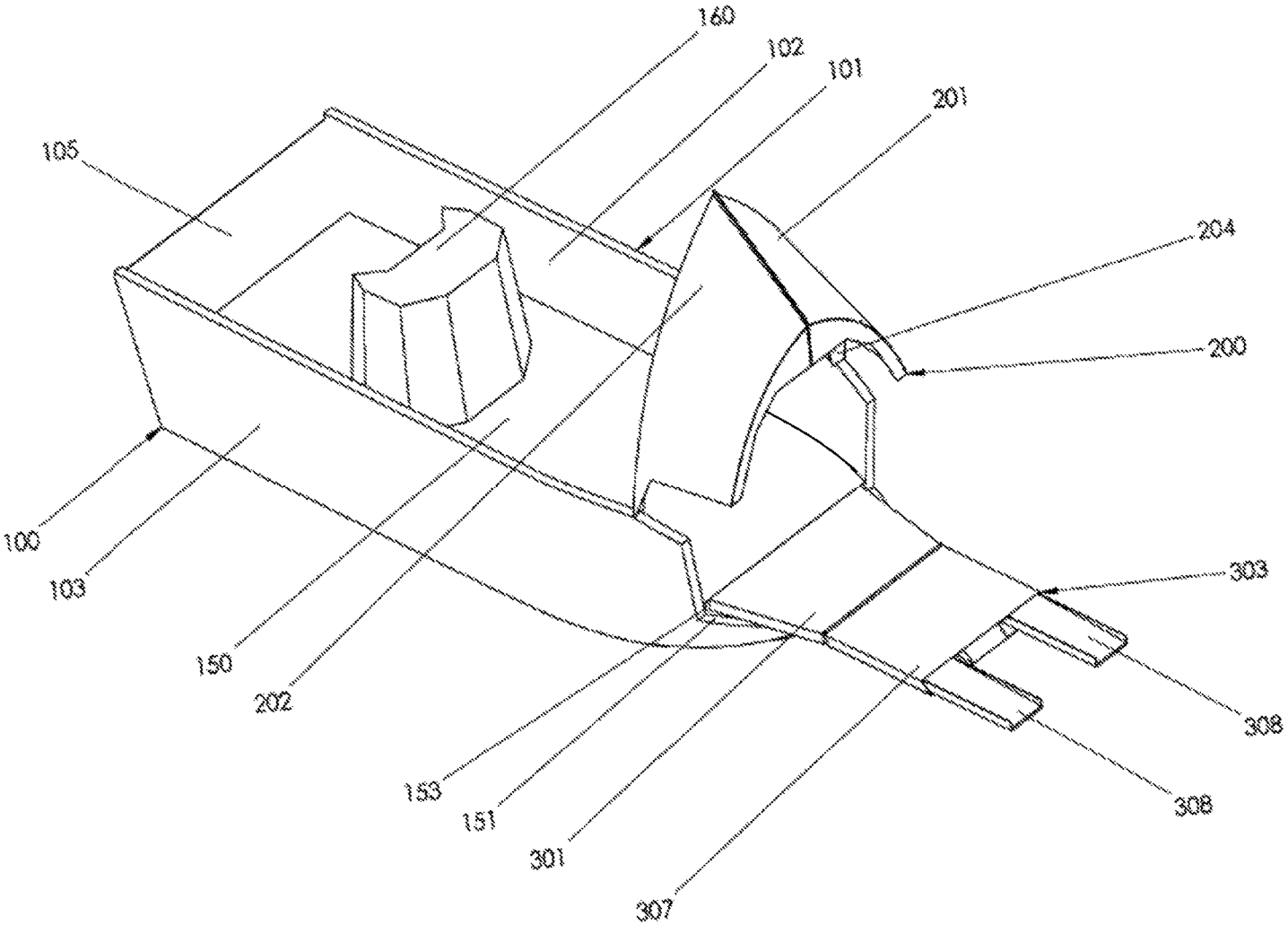
FIG. 12 is a perspective view of the vessel of FIG. 1 but with a bow door moved to an open configuration and a dual section ramp with dual track extensions moved from its intermediate position shown in FIG. 11 to a final extended configuration.
Figure 13:
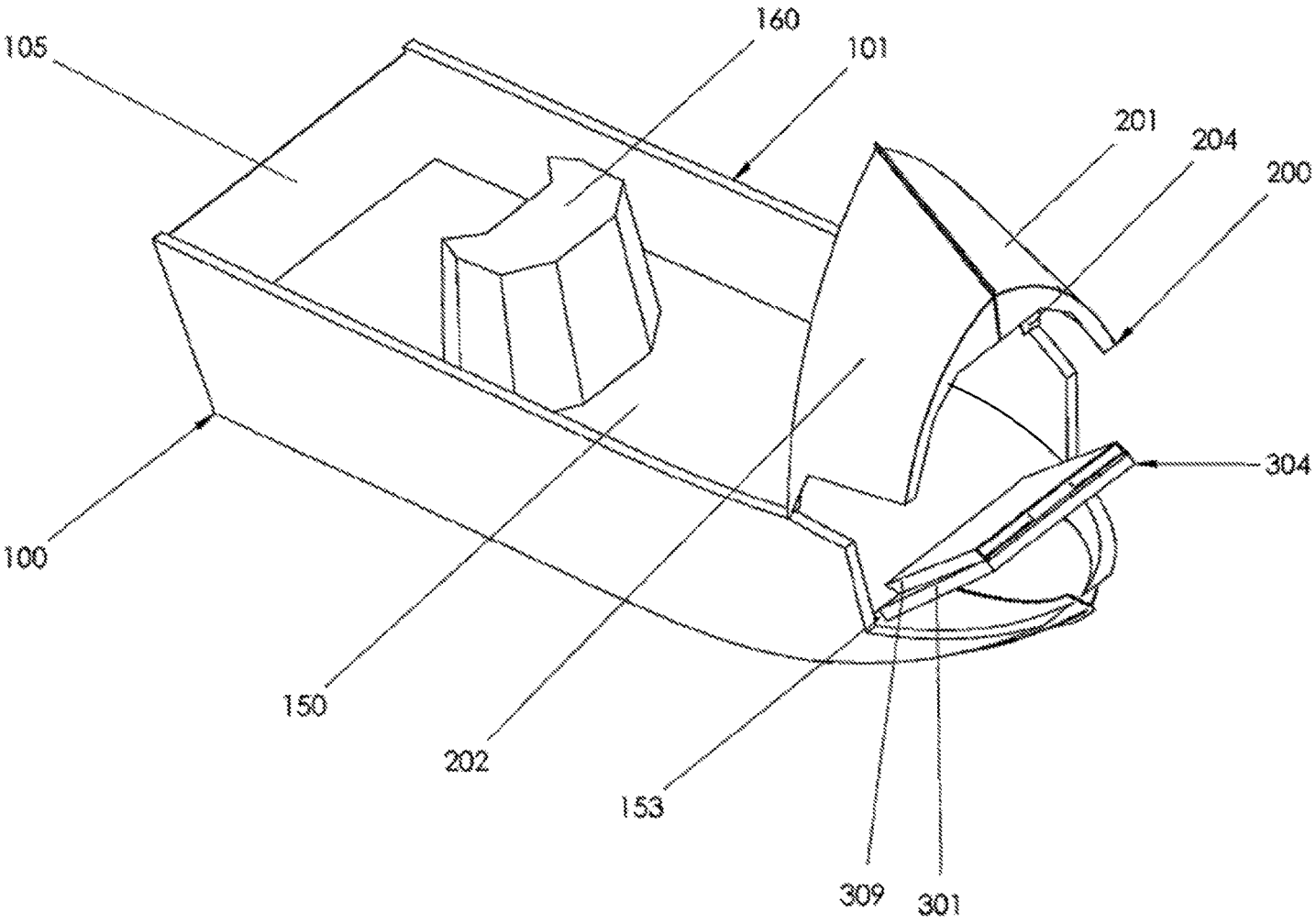
FIG. 13 is a perspective view of the vessel of FIG. 1 but with a bow door moved to an open configuration and a dual section ramp assembly with a single piece track extension folded into its closed configuration.
Figure 14:
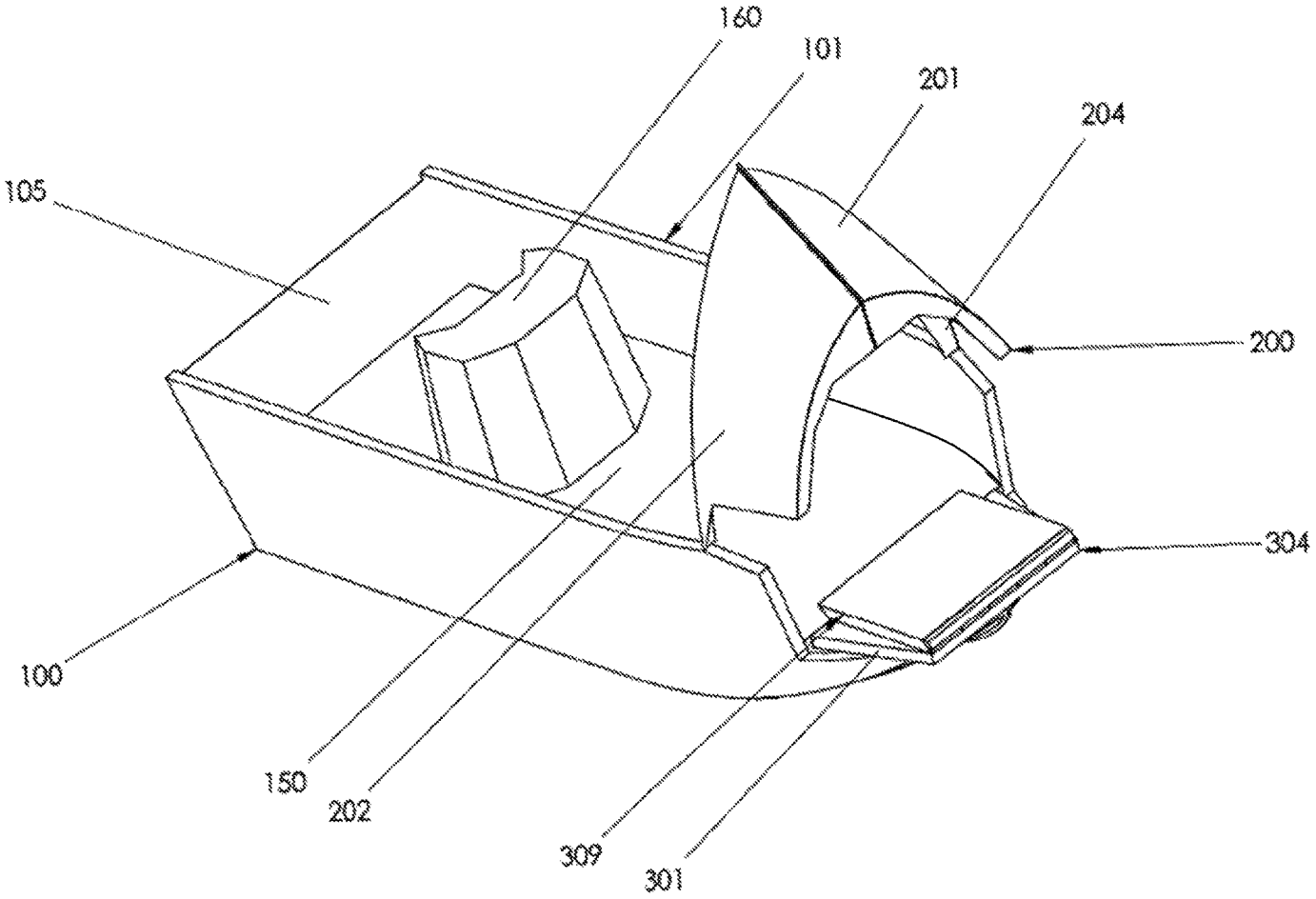
FIG. 14 is a perspective view of the vessel of FIG. 1 but with a bow door moved to an open configuration and a dual section ramp with a single piece track extension moved from its closed position shown in FIG. 13 to a first intermediate configuration.
Figure 15:
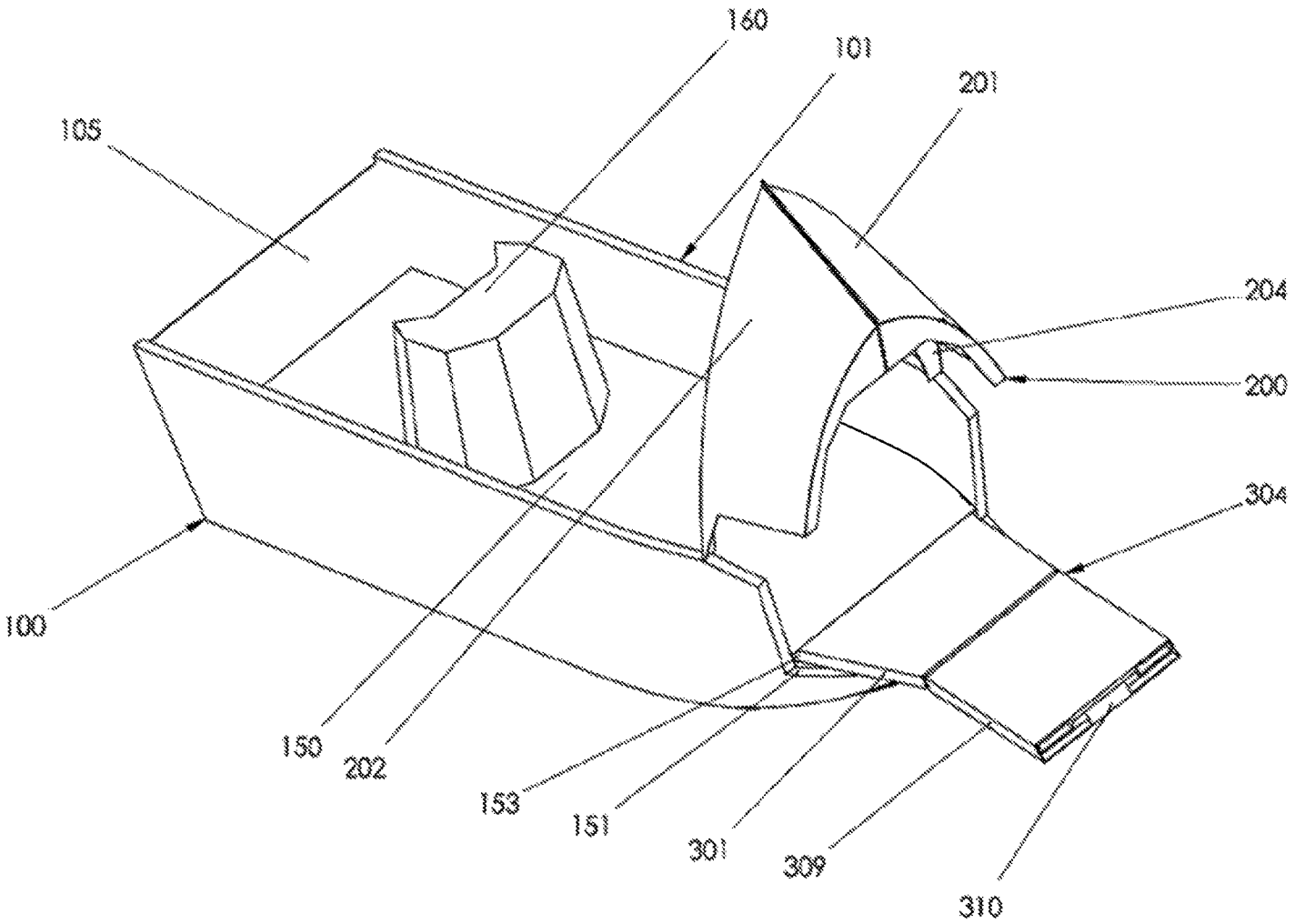
FIG. 15 is a perspective view of the vessel of FIG. 1 but with a bow door moved to an open configuration and a dual section ramp with a single piece track extension moved from its intermediate position shown in FIG. 14 to a second intermediate configuration.
Figure 16:
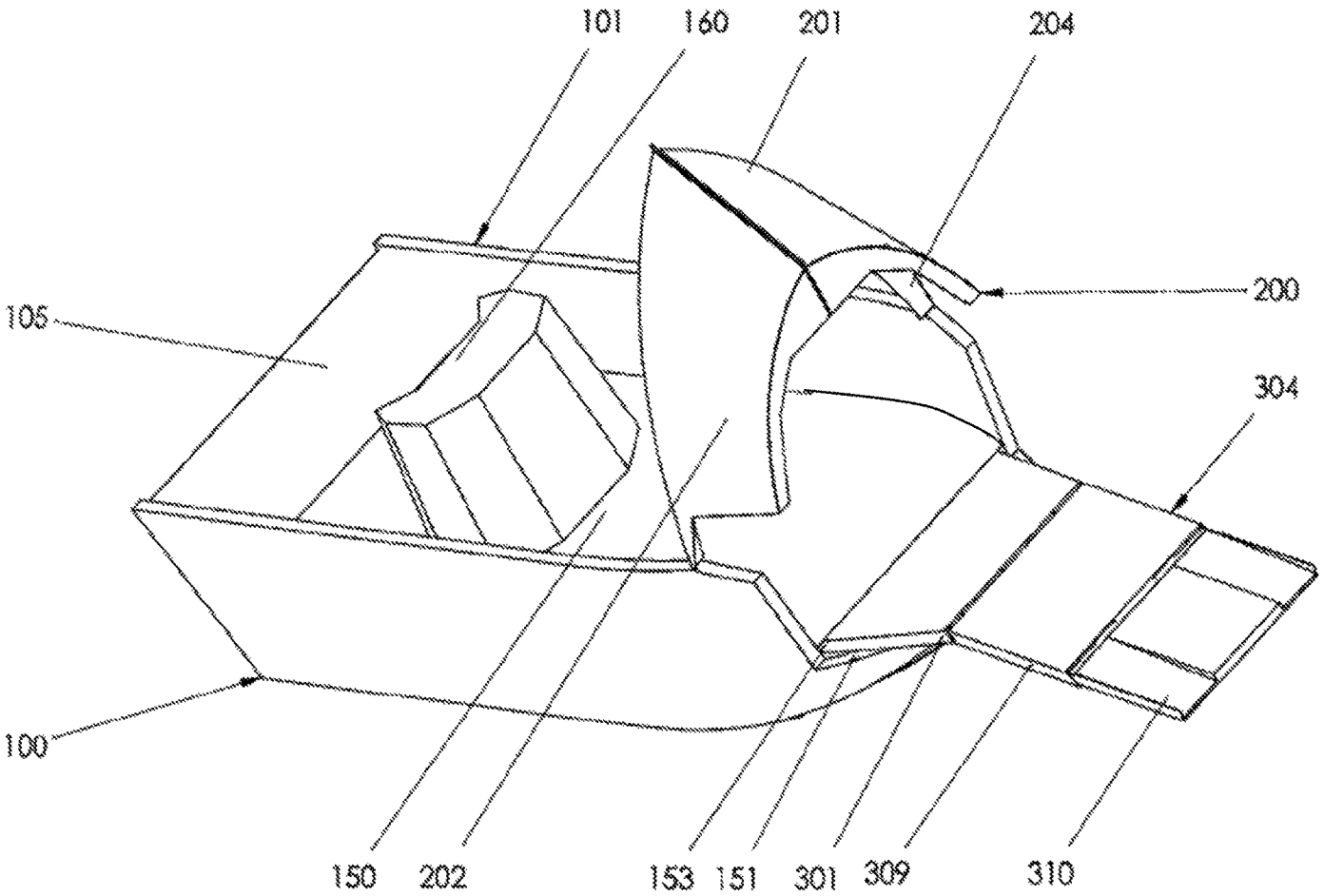
FIG. 16 is a perspective view of the vessel of FIG. 1 but with a bow door moved to an open configuration and a dual section ramp with a single piece track extension moved from its intermediate position shown in FIG. 15 to a final extended configuration.

The vessel 100 includes a planar deck 150 which is a part of the hull 101. The deck or deck area terminates transversely at the forward end at a position longitudinally close to, but not necessarily aligned with, first corner 201 and second corner 202 when the bow section is in the fully closed configuration. As shown in FIG. 4, first and second corners 201, 202 terminate at shared edge 203.

The deck may extend aft to the stern or transom 105 of the hull 101 as shown in FIGS. 1 to 16. In other embodiments the aft or rear end of the deck 150 may terminate transversely in the general area of the control station 160 with other deck pieces 152 located at different, offset, vertical positions, extending from the aft termination of deck 150 to the stern or transom 105 of the hull 101. A smaller forward deck piece 151 extends forward at a position offset from and lower than the deck 150 from a position close to, but not necessarily coincident with, the forward transverse termination of deck 150 to the bow, with the outer edges generally following the curved lines of hull 101 in this area. A plate or surface 153 joins the aft or rear termination of the forward deck 151 and the forward termination of the planar deck 150 to effectively close or seal the open bow area from the interior of the hull 101.

The deck 150 in the present embodiments shown in FIGS. 1 to 17 has planar or flat form, but may, in other embodiments, be formed of multiple pieces which may take the form of, but not limited to, steps or other raised or lowered sections.

The vessel 100 includes a folding ramp assembly 300, 302, 303 or 304 which may take forms shown in FIGS. 2 to 17 but are not limited to these forms. In a first embodiment, illustrated in FIGS. 2 to 4, the folding ramp assembly 300 is formed of two sections, a first section 301 and a second section 305. Adjacent ramp sections are connected one to another at folding interface 315, as shown in FIG. 4. Folding interface may be a hinge or a plurality of hinges. In the fully closed configuration of the ramp assembly 300, shown in FIG. 2, the second section 305 is folded adjacent to the first section 301. The first section 301 is folded with its upper aft edge in a position close to the upper forward edge of deck 150 and with its upper surface at a suitable angle to the upper surface of the deck 150 so that the folded ramp assembly 300 does not extend beyond the upper plate or surface 204 of the movable bow section 200 when the movable bow section 200 is in a closed configuration. In an intermediate configuration of the ramp assembly 300, shown in FIG. 3, the second section 305 is folded adjacent to the first section 301 and the first section 301 is moved to a position with its upper surface nominally aligned with the upper surface of the deck 150. In the fully open configuration of the ramp assembly 300, shown in FIG. 4, the first section 301 remains in a position with its upper surface nominally aligned with the upper surface of the deck 150 and the second section 305 is unfolded to its final position with its upper surface at an angle which may or may not be aligned with the upper surface of the first section 301.

In a second embodiment, illustrated in FIGS. 5 to 8, the folding ramp assembly 302 is formed of three sections, a first section 301, a second section 305 and a third section 306. In the fully closed configuration of the ramp assembly 302, shown in FIG. 5, the second section 305 is folded adjacent to the first section 301 and the third section 306 is folded adjacent to the second section 305. The first section 301 is folded with its upper aft edge in a position close to the upper forward edge of deck 150 and with its upper surface at a suitable angle to the upper surface of the deck 150 so that the folded ramp assembly 300 does not extend beyond the upper plate or surface 204 of the movable bow section 200 when the movable bow section 200 is in a closed configuration. In a first intermediate configuration of the ramp assembly 302, shown in FIG. 6, the second section 305 is folded adjacent to the first section 301, the third section 306 is folded adjacent to the second section 305 and the first section 301 is moved to a position with its upper surface nominally aligned with the upper surface of the deck 150. In a second intermediate configuration of the ramp assembly 302, shown in FIG. 7, the first section 301 remains in a position with its upper surface nominally aligned with the upper surface of the deck 150, the second section 305 is unfolded to its final position with its upper surface at an angle which may or may not be aligned with the upper surface of the first section 301, and the third section 306 remains folded adjacent to the second section 305. In the fully open configuration of the ramp assembly 302, shown in FIG. 8, the first section 301 remains in a position with its upper surface nominally aligned with the upper surface of the deck 150, the second section 305 remains in its final position with its upper surface at an angle which may or may not be aligned with the upper surface of the first section 301 and the third section 306 is unfolded to its final position which may or may not have its upper surface nominally aligned with the upper surface of the second section 305.

In a third embodiment, illustrated in FIGS. 9 to 12, the folding ramp assembly 303 is formed of four sections, a first section 301, a second section 307 and dual track extensions 308. In the fully closed configuration of the ramp assembly 303, shown in FIG. 9, the second section 307 is folded adjacent to the first section 301 and the dual track extensions 308 are retracted into the second section 307. The first section 301 is folded with its upper aft edge in a position close to the upper forward edge of the deck 150 and with its upper surface at a suitable angle to the upper surface of the deck 150 so that the folded ramp assembly 303 does not extend beyond the upper plate or surface 204 of the movable bow section 200 when the movable bow section 200 is in a closed configuration. In a first intermediate configuration of the ramp assembly 303, shown in FIG. 10, the second section 307 is folded adjacent to the first section 301, the dual track extensions 308 are retracted into the second section 307 and the first section 301 is moved to a position with its upper surface nominally aligned with the upper surface of the deck 150. In a second intermediate configuration of the ramp assembly 303, shown in FIG. 11, the first section 301 remains in a position with its upper surface nominally aligned with the upper surface of the deck 150, the second section 307 is unfolded to its final position with its upper surface at an angle which may or may not be aligned with the upper surface of the first section 301, and the dual track extensions 308 remain retracted into the second section 307. In the fully open configuration of the ramp assembly 303, shown in FIG. 12, the first section 301 remains in a position with its upper surface nominally aligned with the upper surface of the deck 150, the second section 307 remains in its final position with its upper surface at an angle which may or may not be aligned with the upper surface of the first section 301 and the dual track extensions 308 are extended to a suitable position from the second section 307.

In a fourth embodiment, illustrated in FIGS. 13 to 16, the folding ramp assembly 304 is formed of three sections, a first section 301, a second section 309 and a single piece track extension 310. In the fully closed configuration of the ramp assembly 304, shown in FIG. 13, the second section 309 is folded adjacent to the first section 301 and the single piece track extension 310 is retracted into the second section 309. The first section 301 is folded with its upper aft edge in a position close to the upper forward edge of the deck 150 and with its upper surface at a suitable angle to the upper surface of the deck 150 so that the folded ramp assembly 304 does not extend beyond the upper plate or surface 204 of the movable bow section 200 when the movable bow section 200 is in a closed configuration. In a first intermediate configuration of the ramp assembly 304, shown in FIG. 14, the second section 309 is folded adjacent to the first section 301, the single piece track extension 310 is retracted into the second section 309 and the first section 301 is moved to a position with its upper surface nominally aligned with the upper surface of the deck 150. In a second intermediate configuration of the ramp assembly 304, shown in FIG. 15, the first section 301 remains in a position with its upper surface nominally aligned with the upper surface of the deck 150, the second section 309 is unfolded to its final position with its upper surface at an angle which may or may not be aligned with the upper surface of the first section 301, and the single piece track extension 310 remains retracted into the second section 309. In the fully open configuration of the ramp assembly 304, shown in FIG. 16, the first section 301 remains in a position with its upper surface nominally aligned with the upper surface of the deck 150, the second section 309 remains in its final position with its upper surface at an angle which may or may not be aligned with the upper surface of the first section 301 and the single piece track extension 310 is extended from the second section 309.

Any of the various ramp assemblies (300, 302, 303 or 304) may be moved to the configurations shown in FIGS. 2 to 16 or, in other embodiments, to other configurations which may involve increased movement or lesser movement of the individual ramp sections. The movements or motions described may be achieved manually, by electric, hydraulic or pneumatic power, or any combination thereof.

Figure 17:
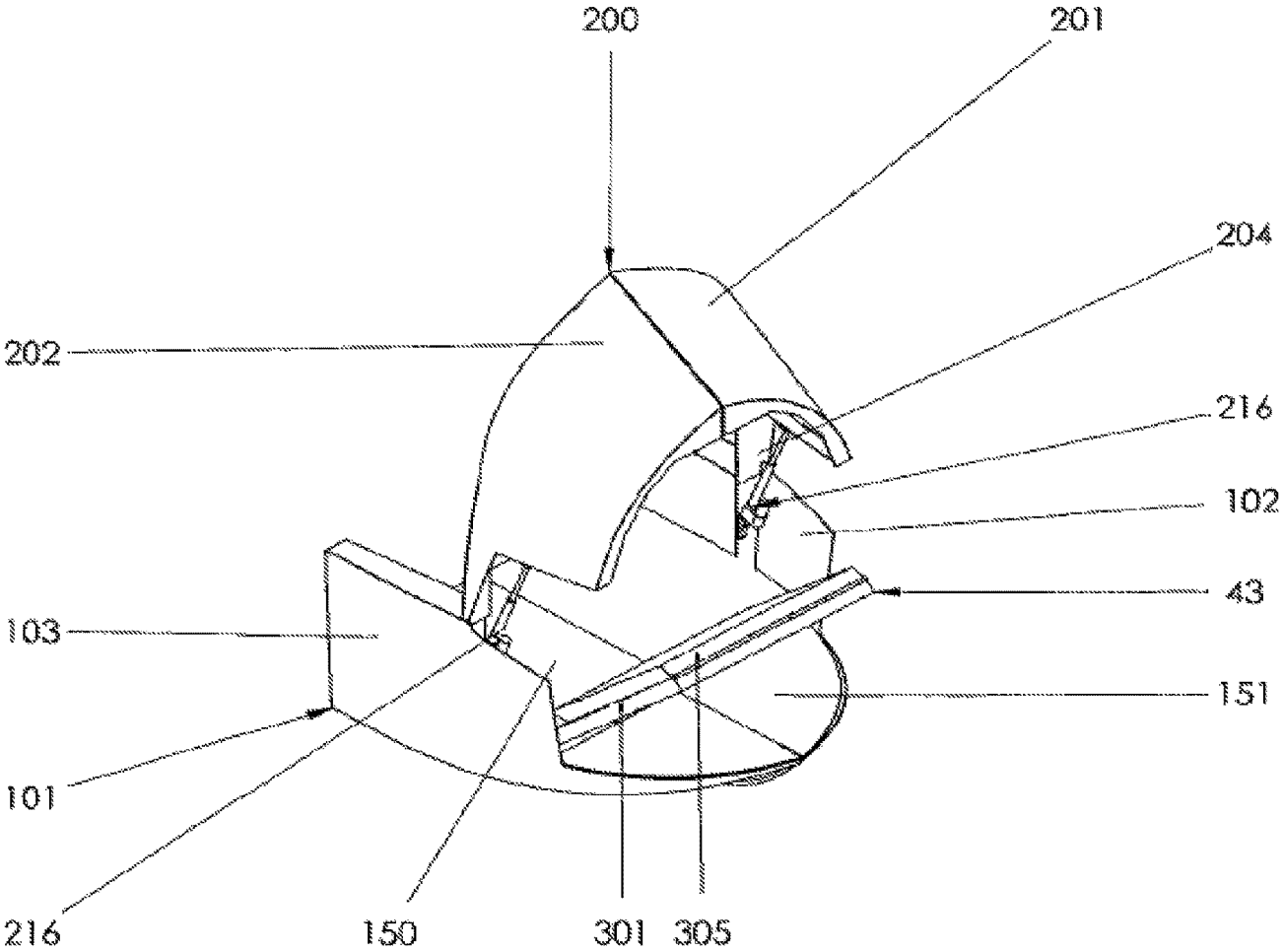
FIG. 17 is a perspective view of the bow area of the vessel of FIG. 1 but with a bow door moved to an open configuration showing the use of electric linear actuators for opening and closing the bow door.

FIG. 17 shows the movable bow section in the open position with power rotation provided by electric linear actuators 216, although it should be understood that the power rotation may be provided by other electrically powered means or by, but not limited to, hydraulic, pneumatic or manual means.

Specifications of certain structures and components of the present invention have been established in the process of developing and perfecting prototypes and working models. These specifications are set forth for purposes of describing an embodiment, and setting forth the best mode, but should not be construed as teaching the only possible embodiment. Rather, modifications may be made without departing from the spirit and scope of the invention as set forth in the following claims. It should be understood that all specifications, unless otherwise stated or contrary to common sense, are +/−10%, and that ranges of values set forth inherently include those values, as well as all increments between.

I claim:

1. A water vessel comprising:

A) A hull having a forward section; and

B) A unitary bow movable between a closed configuration and an opened configuration along a substantially horizontal axis, said unitary bow pivotably connected to said forward section, said unitary bow including a first corner and second corner terminating at a shared edge, wherein said shared edge aligns with the centerline plane of the hull.

2. The water vessel of claim 1 wherein said unitary bow is substantially continuous with said hull when said unitary bow is in the closed configuration.

3. The water vessel of claim 2 wherein an opening is defined between said hull and said unitary bow when said unitary bow is in the opened configuration.

4. The water vessel of claim 1 wherein said unitary bow is driven between a closed configuration and an open configuration by power selected from the group consisting of manual, electrical, hydraulic, pneumatic or combinations thereof.

5. A water vessel comprising:

A) A substantially planar deck;

B) A hull including a forward section, a port side and a starboard side, said hull permanently affixed to said substantially planar deck at said port side and said starboard side but not at said forward section;

C) A unitary bow engaged with said forward section and movable between a closed configuration and an opened configuration along a substantially horizontal axis; and D) A folding ramp assembly including at least two rigid ramp sections connected one to the other at a folding interface, said folding ramp engaged with said planar deck and extendable beyond said forward section.

6. The water vessel of claim 5 wherein said unitary bow is pivotably engaged with said forward section at exactly two pivot points.

7. The water vessel of claim 5 further including at least one track extension extendable from the terminal end of the furthermost ramp section.

8. The water vessel of claim 7 wherein said at least one track extension is a dual track extension, each of said dual track extensions positioned on lateral sides of said ramp section.

9. A method of loading a water vessel comprising the steps of:

A) Raising a unitary bow to create an opening between said bow and a planar deck;

B) Extending a folding ramp assembly beyond said planar deck, said folding ramp including at least two rigid ramp sections connected one to the other at a folding interface;

C) Transporting said cargo along said folding ramp assembly;

D) Passing cargo through said opening to said planar deck; and

E) Lowering said unitary bow to close said opening.

10. The method of claim 9 wherein said step of raising a unitary bow includes the step of pivotably raising said unitary bow along a substantially horizontal axis.

11. The method of claim 9 further including the step of extending at least one track extension from said folding ramp assembly.

* * * * *